US008152086B2

(12) United States Patent
Möller et al.

(10) Patent No.: US 8,152,086 B2
(45) Date of Patent: Apr. 10, 2012

(54) WEAR LINING ELEMENT AND AN ARRANGEMENT FOR THE ATTACHMENT OF SUCH

(75) Inventors: Tage Möller, Skellefteå (SE); Klas-Göran Eriksson, Kåge (SE)

(73) Assignee: Metso Minerals (Wear Protection) AB, Ersmark (SE)

( * ) Notice: Subject to any disclaimer, the term of this patent is extended or adjusted under 35 U.S.C. 154(b) by 284 days.

(21) Appl. No.: 12/452,143

(22) PCT Filed: Jun. 16, 2008

(86) PCT No.: PCT/SE2008/050717

§ 371 (c)(1), (2), (4) Date: Dec. 17, 2009

(87) PCT Pub. No.: WO2009/008810

PCT Pub. Date: Jan. 15, 2009

(65) Prior Publication Data

US 2010/0127109 A1 May 27, 2010

(30) Foreign Application Priority Data

Jul. 10, 2007 (SE) ..... 0701683

(51) Int. Cl.
*B02C 19/00* (2006.01)

(52) U.S. Cl. ..... 241/300; 241/183; 241/DIG. 30

(58) Field of Classification Search ..... 241/182, 241/183, DIG. 30, 300
See application file for complete search history.

(56) References Cited

U.S. PATENT DOCUMENTS

| | | | | |
|---|---|---|---|---|
| 4,065,064 A | | 12/1977 | Anthony | |
| 4,424,938 A | * | 1/1984 | Day | 241/182 |
| 4,580,734 A | * | 4/1986 | Eroskey et al. | 241/182 |
| 4,583,575 A | | 4/1986 | Lundmark | |
| 4,848,681 A | * | 7/1989 | Eriksson et al. | 241/183 |
| 5,431,351 A | * | 7/1995 | Lejonklou | 241/183 |
| 5,516,051 A | * | 5/1996 | Brisbois et al. | 241/172 |
| 6,036,127 A | | 3/2000 | Moller | |
| 6,082,646 A | | 7/2000 | Clarke et al. | |

OTHER PUBLICATIONS

International Search Report for PCT/SE2008/050717 mailed Oct. 14, 2008.

* cited by examiner

*Primary Examiner* — Mark Rosenbaum
(74) *Attorney, Agent, or Firm* — Andrus, Sceales, Starke & Sawall, LLP

(57) ABSTRACT

The invention concerns an arrangement for the joining and attachment of a wear lining element (1) onto a surface that is subject to wear, a supporting surface (5) of a supporting construction (2), comprising attachment means (9) that when anchored in the wear lining element are each one intended to be inserted into attachment holes (10) arranged in the supporting construction whereby the wear lining element is held fastened against the supporting surface by means of supplementary fastening means (16) that are associated with the attachment means positioned to interact with the tensioning surface (11) located on the opposite side of the supporting surface. For rapid and safe fixing, the attachment means (9) comprises a holder (13) fixed attached to the wear lining element (1), a guide (14) designed to guide the wear lining element into place against the supporting surface through interaction with a hole wall in the attachment holes (10) of the supporting construction, a mounting (15) designed to hold the wear lining element fastened against the supporting surface (5) through interaction with the tensioning surface (11) of the supporting construction and fixing and locking means (12) that allow the guide and the mounting to be held in place in a manner that allows exchange, supported by the holder. The invention concerns also a wear lining element intended to be mounted on the inner surface of a rotary grinding drum.

19 Claims, 4 Drawing Sheets

WEAR LINING ELEMENT AND AN ARRANGEMENT FOR THE ATTACHMENT OF SUCH

This application is the U.S. national phase of International Application No. PCT/SE2008/050717 filed 16 Jun. 2008 which designated the U.S. and claims priority to Swedish Patent Application No. 0701683-5 filed 10 Jul. 2007, the entire contents of each of which are hereby incorporated by reference.

The present invention concerns an arrangement for the attachment of a wear lining element onto a surface that is exposed to wear in a supporting construction according to the introduction to claim 1. The invention concerns also a wear lining element for a rotary grinding drum according to the introduction to claim 16

Wall sections that are part of, for example, rotary grinding drums, chutes, channels and similar constructions are subject to wear, and are for this reason provided on their surface that is exposed to wear with a wear lining of wear-resistant material in order to increase the ability of the wall to withstand wear, abrasion, impacts and blows. This wear lining material is normally constituted by an elastomeric material, but it may also consist of other suitable materials with high resistance to wear, such as highly alloyed steel. A wear lining is normally divided into smaller units, known as segments, in the form of wear lining elements that in order to form a cladding are brought into contact next to each other on the side of the supporting construction that is exposed to wear. The wear lining elements are fastened to the support with the aid of fixing screws or bolts that are inserted into special attachment holes arranged in the supporting construction.

Since the wear lining elements are normally brought into contact with the side of the wall or the supporting construction that is exposed to wear while it is mounted using the said attachment holes from the opposite side of the supporting construction, known as the tensioning side, there are major problems associated with adapting each individual wear lining element such that the attachment means are located in the centre of each attachment hole before the wear lining element can be lowered into place.

Since the wear lining elements are relatively heavy, lifting aids, such as the arm of a crane or similar, are required. When installing lining into a rotary grinding drum for which the wear lining elements need to be replaced at relatively frequent intervals, the wear lining elements are lifted into the drum from one end and placed into position inside the drum, on its inner surface. Even if the crane operator is skilled, the actual adaptation of the wear lining elements to the inner surface of the drum is work that is both dangerous and time-consuming.

As has been mentioned above, one of the problems that are most difficult to solve when using wear lining elements as wear protection, is the technology for the rapid and efficient placement and fastening of the wear lining elements in question onto the supporting construction surface, i.e. onto the surface that is to be protected from wear. The known methods that have been suggested include providing the wear lining element with attachment holes such that a certain part of the mounting operation can take place from the side of the wear fining element that faces outwards, and making it possible to adapt the wear lining element such that the relevant attachment holes of the wear lining element and those of the supporting construction are located immediately above each other. In the said position, i.e. when the two holes are located immediately above each other, attachment means are introduced from the side of the wear lining element that is exposed to wear, i.e. from the wear side, in through the two holes such that it becomes possible to access the attachment means from the lower surface of the supporting construction, or more accurately, from the tensioning side of this surface. Such arrangements are known from, for example, U.S. Pat. No. 6,036,127 and U.S. Pat. No. 6,082,646. The disadvantage of this prior art technology is that the wear of the wear lining elements increases due to the cavities that are formed. In particular, wear increases in those zones of the wear lining element that demonstrate holes. The lifetime of the wear lining elements can be increased by avoiding holes in the surface exposed to wear.

One of the problems that is difficult to master when using wear lining elements, in addition to that of the alignment during attachment, is that of achieving wear lining elements with as low an amount as possible of metallic material, without compromising on the requirement that it is to be possible to attach the elements in question rapidly and securely onto the supporting construction, i.e. the surface that is to be protected from wear.

One aim of the present invention, therefore, is to achieve an arrangement for the attachment of wear linings and wear lining elements onto the side of a supporting construction that is exposed to wear such as, for example, the wall or inner surface of a rotary grinding drum, which attachment arrangement leads to improved use and greater freedom during the construction and design of the rubber part, together with rapid and safe attachment of the wear lining elements onto the supporting construction. A further aim of the present invention is to achieve a wear lining element for a rotary grinding drum.

The aim of the invention is achieved with the aid of an arrangement that demonstrates the properties and characteristics that are specified in claim 1, and with the aid of a wear lining element of the type specified in claim 16.

Further characteristics and advantages of the invention are made clear by the non-independent claims.

An embodiment of the invention will be described below with reference to the attached drawings, of which:

Figure 1:
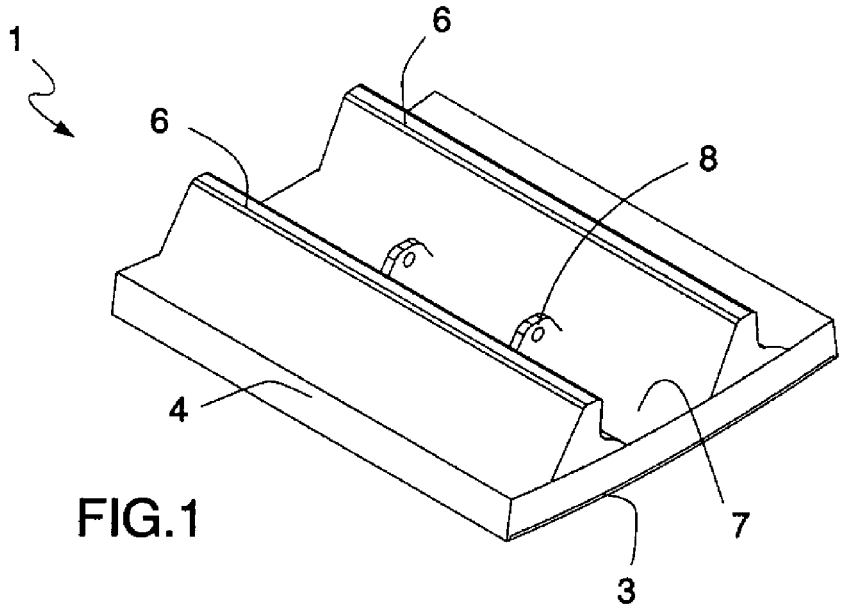
FIGS. 1-2 show a view in perspective of a wear lining element equipped with an attachment arrangement according to the present invention, which wear lining element is viewed obliquely from above and obliquely from below, respectively.
Figure 2:
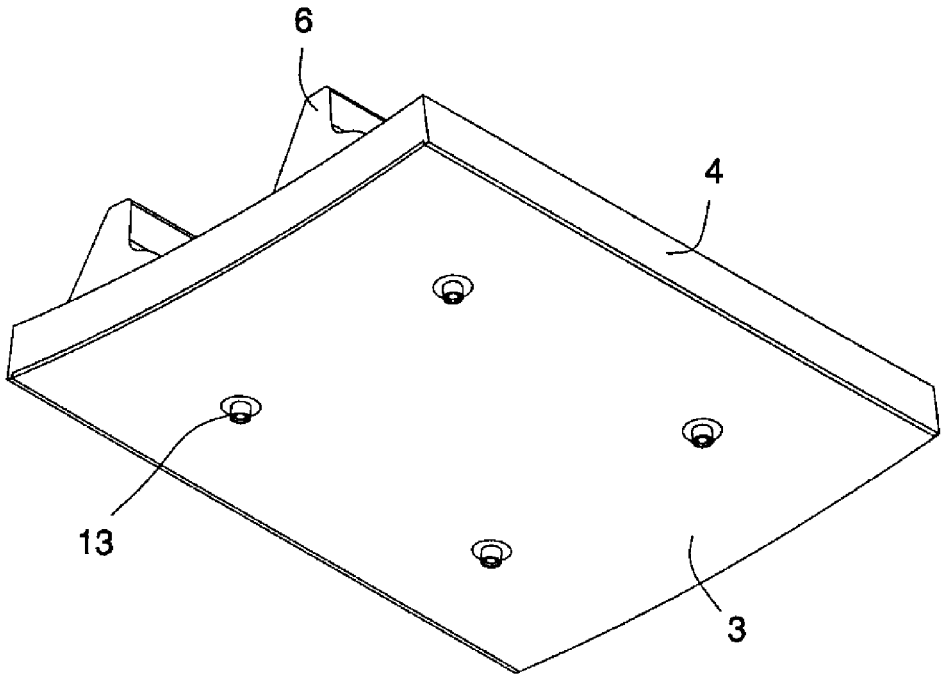

An extended wear lining element of the type that is intended to be placed in a row one after the other in order to form a cladding on the inside of a supporting construction generally denoted by 2 is shown in FIGS. 1 and 2, generally denoted by 1. The said supporting construction is shown in more detail in FIGS. 3-7 and it is constituted in this case by the wall of a rotary grinding drum that is exposed to wear. The wear lining element 1 has a bottom 3 that consists of a reinforcement of metal with wear protection in the form of an upper surface 4 of an elastic or rubber material such as, for example, natural rubber or synthetic rubber such as polyurethane. The wear protection is, naturally, not limited to elastomeric material: it can be constituted by any material that is suitable for the purpose. It may be constituted also by a durable metallic material.

As is made most clear by FIGS. 3-7, the wear lining element 1 is adapted in form to the supporting construction and it demonstrates a bottom 3 that is convex, with a curvature that corresponds to the concave supporting surface 5 of the supporting construction 2. The upper surface 4 of the wear lining element 1 has an irregular shape and is of rubber or an elastomeric material. It is joined to the bottom 3 through vulcanisation, although it would be possible also to attach it by another method, such as gluing.

In order to agitate the charge of ore in the rotary grinding drum the upper surface 4 forms ridges 6 that extend axially along the rotary grinding drum and that protrude in towards the centre of the drum. Lifting loops 8 are arranged on the said upper surface 4 in a valley part 7 that is located at a significantly lower height between two parallel ridges 6, which lifting loops are intended to interact with a hook or similar lifting means that is a component of a lifting accessory such as a crane, with the purpose of facilitating the handling of the wear lining element 1, principally due to the good balance that is obtained in this way. Attachment means 9 are arranged at the bottom of the wear lining element 1 intended for mounting of the wear lining element onto the supporting surface 5 of the supporting construction following introduction of the attachment means into attachment holes 10 arranged in the supporting construction 2. When the said attachment means 9 has been inserted into the attachment hole and extends out from the opposite side of the attachment hole 10, i.e. the side that faces away from the supporting surface 5 of the supporting construction 2 and forms a tensioning surface, the wear lining element 1 can be fastened onto the supporting surface 5 through the attachment means being brought into interaction with the tensioning surface through a fastening means that is a part of the attachment means. The said fastening means may be constituted by, for example, a nut and its associated washer.

FIGS. 3-7 show a series of cross-sections through the said wear lining element 1 and the supporting construction 2 during the insertion of the wear lining element and its mounting onto the supporting surface 5 of the supporting construction 2. The drawings make it clear that the concave supporting surface 5 of the supporting construction 2 is formed by sheet metal reinforcement and a ring-shaped cladding of elastomeric material laid onto this sheet metal. The said cladding is attached to the sheet metal by vulcanisation and forms the above-mentioned tensioning surface 11, which in this case is convex. The attachment means, generally denoted by 9, of the wear lining element protrudes from the convex bottom 3 of the wear lining element and it is, as has been described above, intended to be inserted into attachment holes 10 in the supporting construction 2.

Each attachment means 9 comprises, according to the invention, a number of parts that can be united by interacting fixing and locking means 12, which parts are principally constituted by a holder 13 that is fixed attached to the wear lining element and that protrudes from the bottom 3 of the wear lining element, and two parts that can be united with the holder in a manner that allows them to be removed intended to be supported by the holder in a retentive manner. One of these two unitable parts forms a guide 14 for the insertion or direction of the wear lining element towards the supporting surface 5 of the supporting construction 2 through interaction with the attachment holes 10 of the supporting construction 2. The second of these unitable parts forms a mounting 15 in order to fix and hold in place by pressure the wear lining element 1 against the supporting surface 5 of the supporting construction 2 through interaction with the tensioning surface 11 of the supporting construction 2. The guide 14 and the mounting 15 are shown in more detail in FIGS. 8 and 9. In the embodiment described here, the mounting comprises a supplementary means 16 of fastening that can be adjusted for interaction with the tensioning surface 11 of the supporting construction 2.

Figure 3:
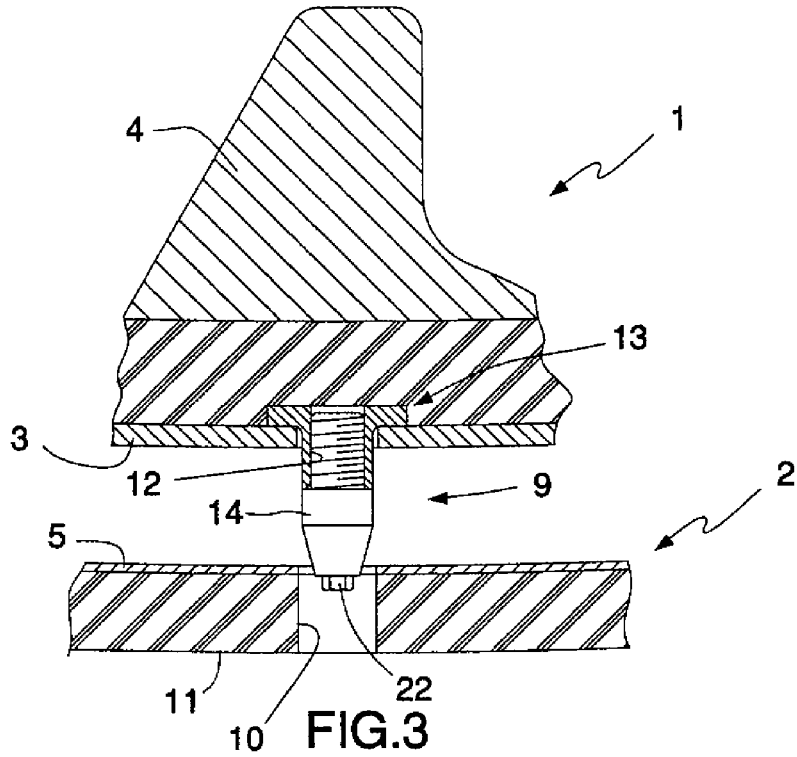
FIGS. 3-7 show cross-sections through the wear lining element shown in FIG. 1 in the form of steps under the anchoring to a surface of a supporting construction exposed to wear, which supporting construction herewith is constituted by the drum wall of a grinding mill.
Figure 4:
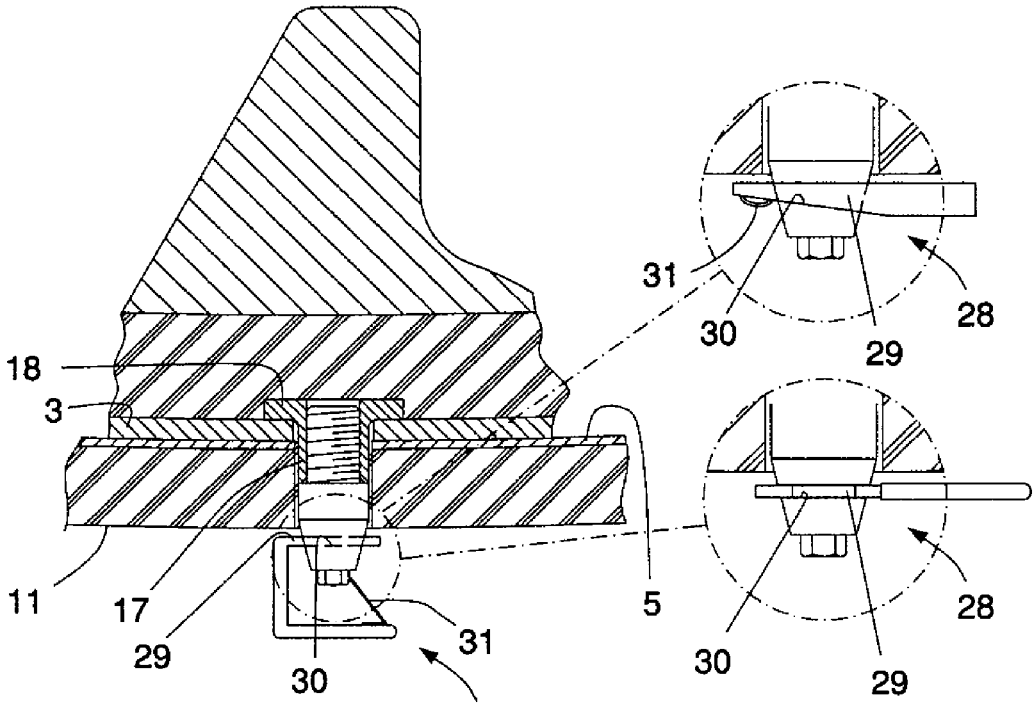
Figure 5:
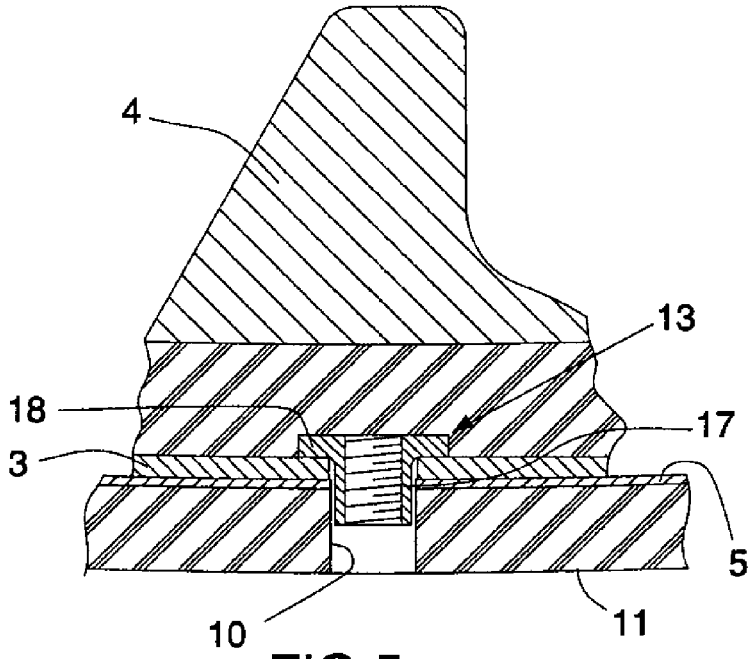

FIGS. 3-5 make it clear that the holder 13 comprises an attachment sheath 17, the fixing and locking means 12 of which are constituted by an internal thread and a flange part 18 that has a relatively large diameter, to which flange the attachment sheath is attached by welding at the bottom 3 of the wear lining element 1 with the attachment sheath protruding from the bottom of the wear lining element.

Figure 8:
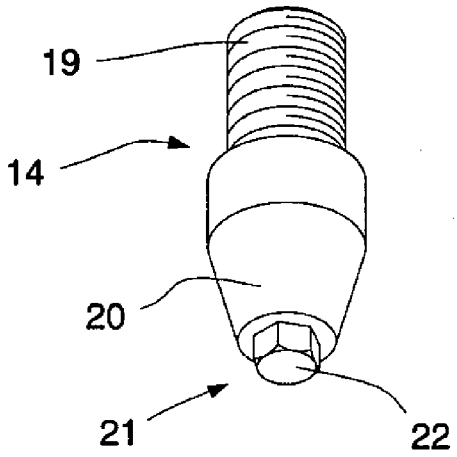
FIG. 8 shows a view in perspective of a guide that is a component of the attachment arrangement.

FIG. 8 makes it clear that the guide 14 comprises an element having the form of a peg, the fixing and locking means of which are constituted by a stud-shaped section 19 with circular cross-section, which stud-shaped section is provided with an external thread and can be united by screwing with the holder 13 and with a part 20 that is circularly cylindrical and has the form of a peg, which part 20 narrows towards its free end in a conical manner and whose cylindrical diameter exceeds the diameter of the stud-shaped part 19. FIG. 3 makes it clear that the attachment sheath 17 of the holder 13 and the circularly cylindrical part of the guide 14 have been given corresponding outer diameters. The part 20 that has the form of a peg has been given the dimensions required to ensure that it acts as guidance towards the holed wall with the attachment holes 10 of the supporting construction 2 during adaptation of the wear lining element 1 to the supporting surface 5 of the supporting construction 2. The guide 14 is provided at its free end with a means 21 that has been designed for rotation and that can be accessed such that the guide can be placed into and removed from locking interaction with the holder 13. This turning means 21 comprises a grip 22 arranged at the free end of the part 20 that has the form of a peg, designed for interaction with a turning tool. Since the turning means 21 is arranged at the free end of the guide 14, it is possible, as FIG. 4 makes most clear, to access the turning means also for the loosening and removal of the guide 14 from the holder 13 when the guide is located in the attachment hole 10.

Figure 9:
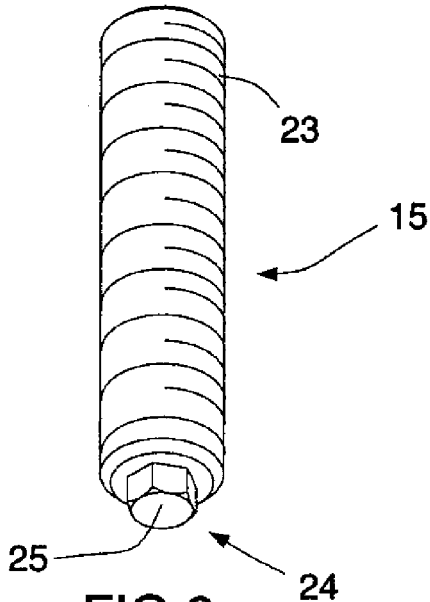
FIG. 9 shows a view in perspective of a mounting that is a component of the attachment arrangement.

With reference also to FIG. 9, the mounting 15 comprises fixing and locking means 12 designed as a stud bolt 23 by which it is possible to screw the mounting into the holder 13. It is possible to access also the mounting 15 with the aid of a turning means 24 in order to place the guide into and remove the guide from locking interaction with the holder 13. The said turning means 24 comprises a grip 25 arranged at the free end of the mounting 15, intended for interaction with a turning tool and for attachment of the mounting 15 in the holder 13 and for removal of the same from the holder through the interacting threads of the two parts. The fastening means 16 that is associated with the mounting 15 is shown in more detail in FIG. 7 and it comprises a nut 26 that interacts with the stud bolt 23 and a washer 27 that is intended to be placed between the said nut and the tensioning surface 11 of the supporting construction 2. Also a rubber washer is arranged between the washer 27 and the tensioning surface 11. It should be understood that the wear lining element 1 is pressed against the supporting surface 5 of the supporting construction 2 when the nut 26 is tightened against the tensioning surface 11 of the supporting construction 2.

FIG. 4 and the enlarged details shown with dot-dashed lines make it clear that the present attachment arrangements comprise a locking means generally denoted by 28 that makes possible rapid and temporary attachment of the wear lining element 1 onto the supporting surface 5 of the supporting construction 2. The opportunity for rapid temporary attachment of the wear lining element is particularly interesting in certain applications since it contributes to shortening the assembly period. Not least for the exchange of drum linings in grinding mills is this important, since it reduces the requirement for dangerous operations inside the grinding drum itself while the final mounting operation can be carried out externally and from the tensioning side of the rotary grinding drum as a subsequent operation at a suitable later time. Such a suitable later time is immediately before the mill is to be taken into operation.

In a first alternative embodiment, the temporary locking means 28 can comprise a first lock member 29 in the form of a U-shaped element and a second lock member 30 in the form of a hole in the guide 14 that corresponds to one of the legs or shanks of the U-shaped element. FIG. 4 makes it clear that the leg of the first lock member 29 is intended to be inserted into the said hole for temporary locking of the wear lining element 1 onto the supporting surface 5 of the supporting construction 2 through interaction between the guide 14 and the temporary locking means against the tensioning surface 11 of the supporting construction. The locking member 29 enters into locked, or self-limiting, interaction with the second lock member 30 through the influence of a snap fastener 31 in the form of a spring metal plate that is a component of the lock member 28.

As is shown in the enlargement of details in FIG. 4, the first lock member 29 can in a second alternative embodiment comprise a wedge designed to interact with a second lock member 30 in the form of a hole arranged in the guide peg with a form that corresponds to that of the wedge.

The first lock member 29 can in a third alternative embodiment comprise a key that has been given U-shaped forked shanks at one of its ends, which shanks are to engage with the guide 14 in a manner that provides locking through surrounding at an angle greater than 180° a sector of a circle of a circumferential track arranged in the guide. This means that the forked shanks are sprung shanks, and have such a length that they snap onto the said circumferential track.

FIGS. 3 and 4 make it clear that the present lock arrangement acts in the following manner: After engagement of the guide 14 into the holder 13 with the aid of a suitable turning tool in interaction with the grip 22, the wear lining element 1 is introduced and guided down in towards the concave supporting surface 5 of the supporting construction 2 through interaction between the guide 14 and the holed wall of the attachment holes 10 of the supporting construction. With the wear lining element 1 in place, the wear lining element 1 can be temporarily fixed onto the concave supporting surface 5 of the supporting construction 2 by means of the locking means 28 and in that the locking members 29, 30 are brought into positions at which they interact.

Figure 6:
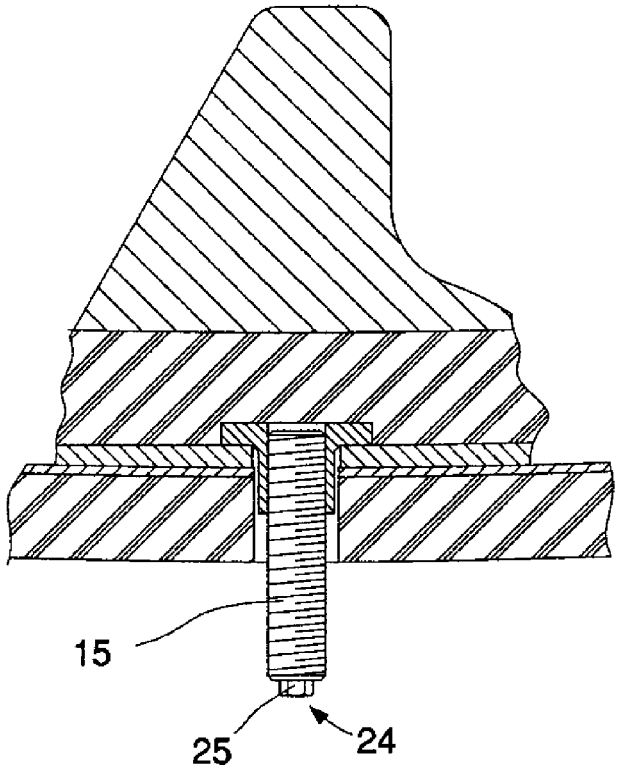
Figure 7:
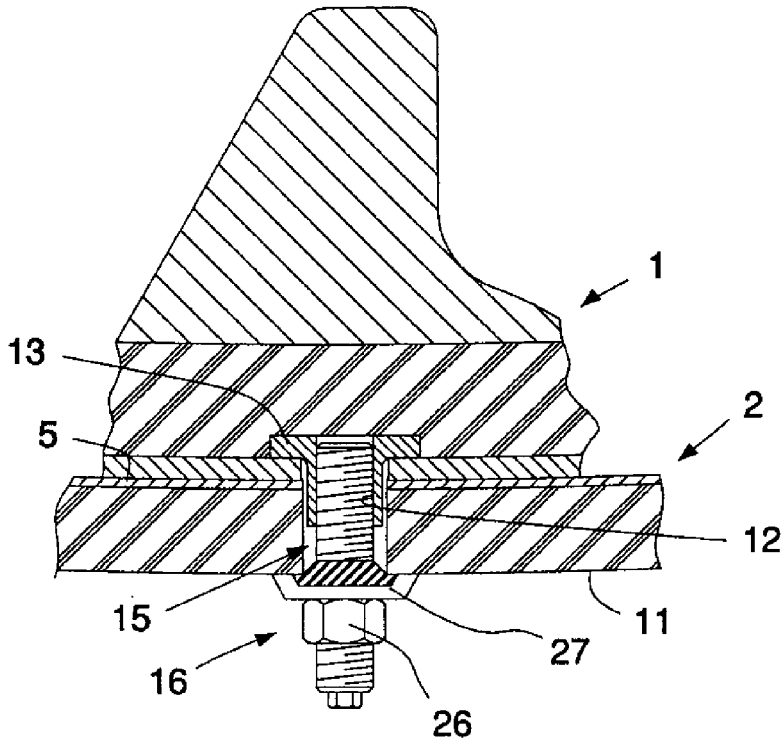

FIGS. 5-7 make it clear that following loosening and removal of the guide 14 that has been inserted into the attachment hole 10 from the holder 13 of the wear lining element 1 by means of a suitable tool in interaction with the grip 22, the mounting 15 is attached in the holder 13, an operation that is carried out by means of a turning tool in interaction with the grip 25 of the mounting, and screwing the mounting into the holder. Finally, the wear lining element 1 is fastened against the concave supporting surface 5 of the supporting construction 2 through the fastening means 16, in the form of nut 26 and washer 27 and sealing washer, that is associated with the mounting 15 being tightened by means of a suitable turning tool onto the tensioning surface 11 of the supporting construction 2.

The present arrangement is not limited to that which has been described above and shown in the drawings: it can be changed and modified in a number of different ways within the framework of the innovative concept specified by the attached patent claims. It should be understood, for example, that it would be possible to replace the mounting 15 and its associated fastening means 16 by a suitable screw or bolt provided with a casing.

The invention claimed is:

1. An arrangement for the attachment of a wear lining element onto a surface that is exposed to wear, a supporting surface of a supporting construction, comprising attachment means that when anchored in the wear lining element are each one intended to be inserted into attachment holes arranged in the supporting construction, whereby the wear lining element is fastened against the supporting surface by means of supplementary fastening means that are associated with the attachment means and positioned to interact with a tensioning surface located on an opposite side of the supporting surface, characterised in that the attachment means comprises a holder fixedly attached to the wear lining element, a guide designed to guide the wear lining element into place against the supporting surface through interaction with a hole wall in the attachment holes of the supporting construction, a mounting designed to hold the wear lining element fastened against the supporting surface through interaction with the tensioning surface of the supporting construction, and fixing and locking means that allow the guide and the mounting, respectively, to be held in place in a manner that allows exchange, supported by the holder.

2. The arrangement according to claim 1, comprising temporary locking means that make it possible to temporarily lock the wear lining element against the supporting surface of the supporting construction through interaction between the guide and the tensioning surface of the supporting construction.

3. The arrangement according to claim 2, wherein the temporary locking means comprises a first locking member and a second locking member that act together, the second locking member being arranged at the guide.

4. The arrangement according to claim 3, wherein the first locking member can be introduced into the second locking member and the locking members are held fixed in a united condition through the influence of a snap device that acts between the members.

5. The arrangement according to claim 1, wherein the fixing and locking means allows both the guide and the mounting to be united with the holder in a manner that allows them to be removed.

6. The arrangement according to claim 1, comprising means that can be accessed from the tensioning surface after they have been united with the attachment holes and that allow the guide to be released and removed from the holder.

7. The arrangement according to claim 6, wherein the means for the release and removal of the guide from the holder comprises a turning means arranged on the guide designed for interaction with a turning tool.

8. The arrangement according to claim 7, wherein the turning means comprises grips arranged at a free end of the guide designed for interaction with a wrench key.

9. The arrangement according to claim 1, wherein the fixing and locking means with which the guide and the mounting are held in place by the holder in a manner that allows exchange comprise a threaded joint that acts between the respective parts.

10. The arrangement according to claim 1, wherein the holder comprises an attachment sheath provided with an internal thread that protrudes from the wear lining element.

11. The arrangement according to claim 1, wherein the guide is extended and comprises a part that has the form of a stud that is circular and is provided with an external thread that can be united with the holder by screwing, and a circularly cylindrical part that has the form of a peg that narrows in a conical manner towards a free end.

12. The arrangement according to claim 11, wherein a turning means of the guide is arranged at the free end of the part that has the form of a peg.

13. The arrangement according to claim 1, wherein the mounting comprises a screw means with the form of a stud that can be screwed into the holder.

14. The arrangement according to claim 1, wherein the mounting comprises a turning means that allows the mounting to be released from the holder.

15. The arrangement according to claim 14, wherein the turning means of the mounting is arranged at a free end of the mounting.

16. A wear lining element intended to be mounted on an inner surface of a rotary grinding drum, comprising an arrangement for the uniting and fixing of the type that is specified in claim 1.

17. The wear lining element according to claim 16, comprising a bottom of sheet metal with a convex form with a curvature that corresponds to the concave inner surface of the rotary grinding drum, and an upper surface of a wear-resistant material with an irregular form.

18. The wear lining element according to claim 17, wherein the wear-resistant material comprises one of rubber and an elastomeric material and is united with the bottom through vulcanisation.

19. The wear lining element according to claim 18, wherein the upper surface has the form of two ridges that are separated by a distance and run parallel to each other and that protrude in towards a centre of the drum, and a part that has the form of a valley and lies at a significantly lower height situated between the two ridges, and in which part having the form of a valley lifting hooks are arranged that are intended for interaction with a hook or similar lifting means that is a component of a lifting accessory.

* * * * *